United States Patent [19]

Platzer, Jr.

[11] 3,991,961

[45] Nov. 16, 1976

[54] COLLAPSIBLE SUPPORT STRUCTURE

[76] Inventor: George E. Platzer, Jr., 31881 Staman Court, Farmington Hills, Mich. 48024

[22] Filed: Mar. 3, 1975

[21] Appl. No.: 554,440

[52] U.S. Cl. ..... 248/99; 248/226 A; 248/291; 248/311.1; 248/315

[51] Int. Cl.[2] ..... B65B 67/12

[58] Field of Search ..... 248/95, 99, 226 A, 210, 248/311 R, 291, 300, 302, 315, 101; 38/104, 142; 150/1

[56] References Cited

UNITED STATES PATENTS

| | | | |
|---|---|---|---|
| 156,059 | 10/1874 | Jordan et al. | 248/315 X |
| 370,214 | 9/1887 | Smith | 248/291 X |
| 1,548,986 | 8/1925 | Donovan | 248/99 |
| 1,565,118 | 12/1925 | Stugard | 248/101 X |
| 2,160,658 | 5/1939 | Hedquist | 248/99 |
| 2,473,429 | 6/1949 | Hinman | 150/1 X |
| 2,726,477 | 12/1955 | Firkins | 248/99 X |
| 3,055,129 | 9/1962 | Selleck | 38/142 X |
| 3,141,257 | 7/1964 | Stull | 248/226 A X |
| 3,695,565 | 10/1972 | Hodges | 248/99 X |

OTHER PUBLICATIONS

B390,732, Jan. 1975, Wayne, 248/226 A X.

*Primary Examiner*—Roy D. Frazier
*Assistant Examiner*—Rodney H. Bonck

[57] ABSTRACT

A mounting bracket carries pivoting means which, in turn, carries a holder portion for holding a related article to be supported; such pivoting means providing for the easy movement of the holder portion from a first operative position to a second inoperative position when the use of such holder portion is no longer needed.

5 Claims, 4 Drawing Figures

COLLAPSIBLE SUPPORT STRUCTURE

BACKGROUND OF THE INVENTION

Frequently in the performance of a task, a related article such as a tool or a container or some substance, is used to assist in the performance of that task. For example, spray bottles of window cleaner are used in washing windows, and spray cans of starch or material sizing are used in ironing. It often happens that there is no convenient place to temporarily put the related article during that portion of the task when it is not in use. The window cleaner cannot be put on the ladder shelf without being easily knocked off, and the starch container cannot be left on the ironing board because it is in the way. Yet, any other location requires excessive reaching.

A fixed bracket could be provided to hold or support the related article, but in many applications a fixed and rigid holder would be unsatisfactory. In the case of the ladder and ironing board, a fixed and rigid holder would be quite unsatisfactory since it would be an annoying excrescence to contend with when the ladder or ironing board is stored.

SUMMARY OF THE INVENTION

This invention is directed to a holder as for a container or a related article of some type. The holder may be attached to a work surface or some object in the vicinity of the work area. When the holder is in use, it is deployed in such a manner that it will hold say a tool or a container. When it is not in use, it rotates so that it will be out of the way and unable to be damaged or produce damage itself.

Hence, a general object of this invention is to provide a holder for a related article used in the performance of a task.

Another object of this invention is to provide a holder which may be attached to a work surface or to an object in the vicinity of the work surface.

Still another object of this invention is to provide a holder which may be easily placed in a storage position so that it neither can be damaged nor produce damage when it is not in use.

Other objects and advantages will become apparent when reference is made to the following detailed description considered in conjunction with the accompanying drawings.

BRIEF DESCRIPTION OF THE DRAWINGS

In the drawings, wherein for purposes of clarity certain elements and/or details may be omitted from one or more views.

DETAILED DESCRIPTION OF THE PREFERRED EMBODIMENTS

Figure 1:
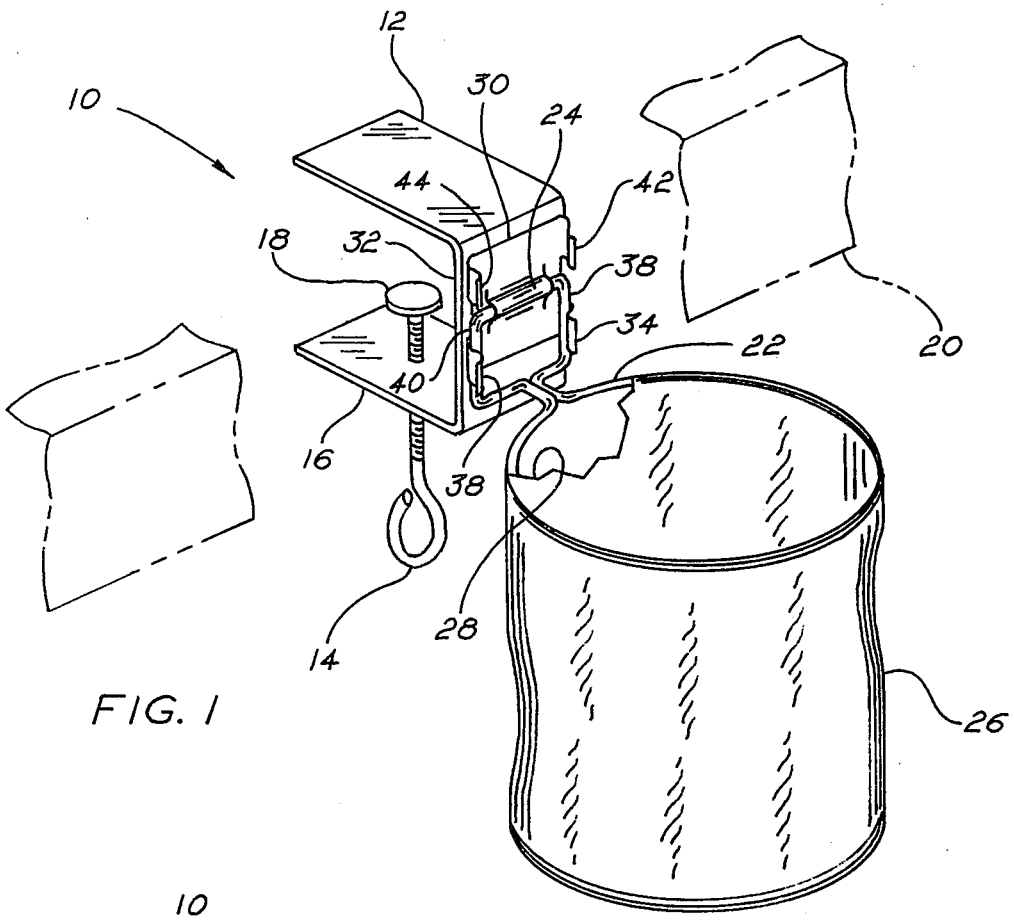
FIG. 1 is a perspective view of a collapsible support structure constructed in accordance with the teachings of the invention.

Referring now in greater detail to the drawings, FIG. 1 illustrates the support structure 10 comprising U-shaped section 12 and an eyebolt 14 threaded through the lower leg 16 of U-shaped section 12. A load spreading flat disc 18 is suitably attached to eyebolt 14. Elements 12, 14, and 18 comprise a clamp or detachable securing means which in use may be attached to an associated support member or means 20 as shown in FIG. 2 by object lines and partially indicated by phantom lines in FIG. 1.

Again referring to FIG. 1, a hoop shaped member 22 is shown hinged or pivoted at a region 24. The hoop shown is made of wire, but it could also be produced as a metal stamping or a molded plastic. Suspended from hoop 22 is a bag or cup shaped element 26. This bag may be made of any flexible or yieldable material such as cloth or plastic. It may be attached to hoop member 22 by a number of methods such as by a sewn hem, heat sealing, or cementing. A section 28 of bag 26 has been shown cut out to more clearly show the hoop structure.

When the support structure 10 is attached, as to associated support surface means 20, the article to be held thereby fits down into the bag 26. FIG. 1 shows the bag in its deployed position ready to receive an article.

Figure 2:
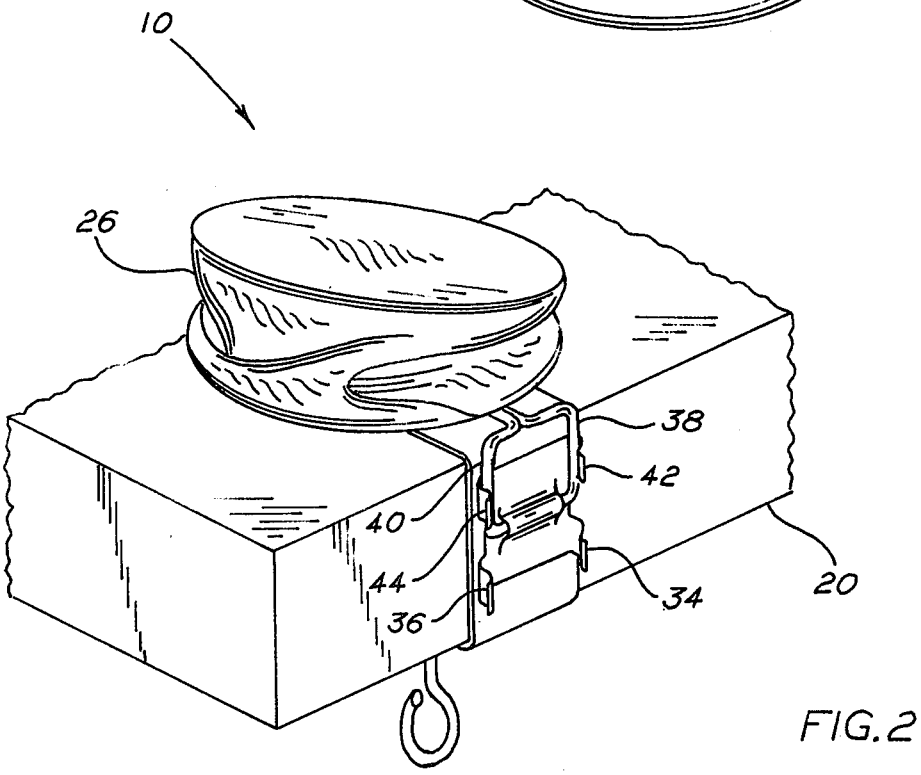
FIG. 2 is a perspective view of the support structure of FIG. 1, but illustrating certain of the elements thereof in respective positions different from those of FIG. 1.

FIG. 2 shows the bag in its storage position or condition, where it is held flat against the surface of associated support means 20. As shown, the flexible bag has collapsed downward. If it were attached to say an ironing board stored in the vertical position, it would simply collapse down sideways. In any case, the bag can be rubbed against without doing any damage, and no special handling precautions are necessary as a result of the attached support structure 10.

In FIGS. 1 and 2 a detent-like member 30 is shown attached to the bight portion 32 of U-shaped member 12. Depending on the material used, such member 30 could be spot welded or riveted to bight portion 32. Member 30 serves several functions. First, it provides a hinge or pivot region 24 for hoop member 22. This pivot region 24 is an open ended ridge formed in member 30, and it serves as a bearing for journaling the ends of the wire used in forming hoop member 22, which now act as shafts to rotate in pivot region 24. These shafts point inwardly to engage the bearings, and the spring tension of hoop member 22 keeps them in place.

A second function of member 30 is provided by side members 34 and 36 which provide side thrust support for hoop member 22 when it is in the position shown in FIG. 1. Without such side support, it is possible for the shaft ends to be pushed out of the bearings if side thrust is applied from the inside of the hoop when putting an aticle in bag 26. Wire sections 38 and 40 form an extension section of the hoop shaped member 22 which is perpendicular to the plane of the hoop open area. This extension section lies parallel to and against the bight portion 22, and in the position shown in FIG. 1, it holds the hoop and bag in position to receive and support an article. Thus, side members 34 and 36 are seen to abut wire sections 38 and 40, thereby providing side thrust reaction members in the position shown in FIG. 1.

A third function of member 30 is provided by side members 34, 36, 42, and 44. These side members provide detent action. As seen in FIG. 1, side members 34 and 36 partially clamp around wire sections 38 and 40 in the deployed position of the bag. In FIG. 2, which shows the storage position of the hoop and bag, side members 42 and 44 also partially clamp around wire sections 38 and 40. Hence, it is seen that the detent action of side members 34, 36, 42 and 44 positively holds the hoop member 22 in both the deployed and storage conditions.

Hoop member 22 is shown as having a circular open section. It should of course be evident that it may in fact be of any desired shape suitable for in turn holding or supporting the collapsible cup-like means 22.

Figure 3:
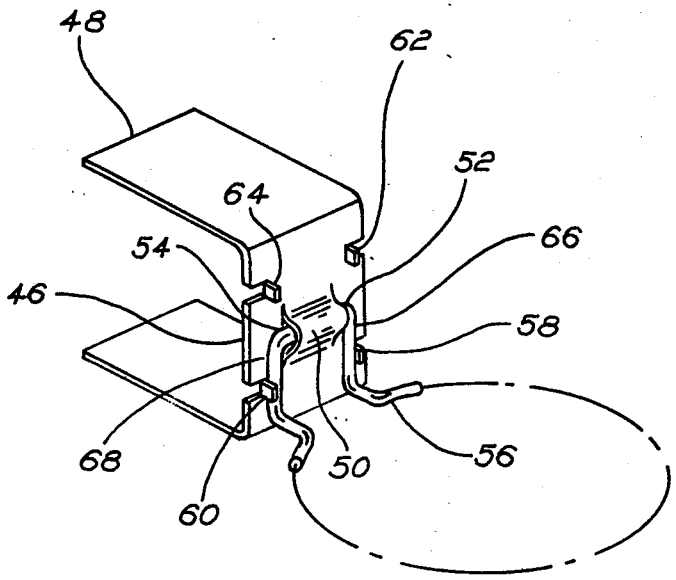
FIG. 3 is an alternate method of constructing certain of the elements of FIGS. 1 and 2.

FIG. 3 shows an alternate way of providing bearings, side thrust reaction members, and detent action. Here, all the necessary elements are formed directly out of the bight section 46 of a U-shaped section 48. An open ended ridge 50 is formed out of bight section 46, and the inwardly pointing ends 52 and 54 of a hoop 56 are inserted into the open ends of the ridge. Hoop 56 is only partially shown. Tabs 58 and 60 are directly formed out of bight section 46 and are seen to provide side thrust reaction in the deployed position of the hoop. Tabs 62 and 64 are also formed out of bight section 46. These tabs are located such that when the hoop is swung into the storage position, wire sections 66 and 68 lightly straddle them. This provides detent action in the storage position.

Figure 4:
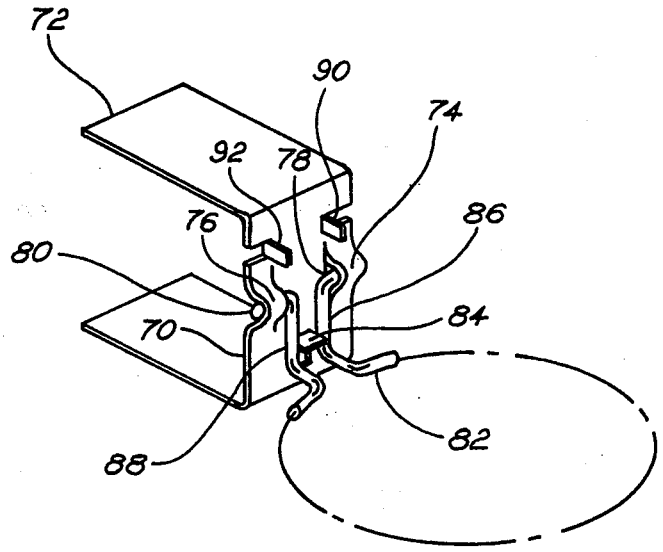
FIG. 4 is another alternate method of constructing certain of the elements of FIGS. 1 and 2.

FIG. 4 shows another alternate way of providing bearings, side thrust reaction members, and detent action. Again, as in FIG. 3, all the necessary elements are formed out of a bright section 70 of a U-shaped structure 72. Here however, the bearings are comprised of two colinear and spaced open ended ridge sections 74 and 76 formed out of bight section 70, and the outwardly pointing ends 78 and 80 of a hoop member 82 are inserted into the inward open ends of the ridges. Hoop member 82 is only partially shown. Again, the spring tension of the hoop member holds the shaft in place. Ridge sections 74 and 76 are shown as being drawn or stretched out of the bight section. In addition to being drawn, the ridges could also be cut at one end and wrapped to form the bearing. This latter procedure eliminates a deep draw and provides greater latitude in the choice of alloy used.

In the configuration of FIG. 4, it is not necessary to provide side thrust protection from putting an article in the bag, because side thrust from inside the bag simply pushes the shaft against the inner end of the bearing. However, a push against the outside of the hoop can force a shaft out of a bearing. To prevent this from happening, a side thrust reaction tab 84 is formed out of bight section 70. Detent action can be obtained in the deployed position by making tab 84 wide enough to require sections 86 and 88 to forcibly straddle tab 84. Detent means for the storage position could be obtained by means of a tab similar to 84 but located above the bearings, or it could be obtained by means of tabs such as 90 and 92 formed out of bight section 70. Tabs 90 and 92 are spaced so that wire sections 86 and 88 are lightly forced between them.

FIGS. 1 through 4 show a variety of ways of providing bearings, detent members, and side thrust reaction members. Some are formed out of the bight portion of a U-shaped member, others are provided by means of an auxiliary member attached to the bight portion. Depending upon the dimensions and characteristics of the materials used, various combinatons of the structures shown may be used. For example, in one implementation of the type of structure described, the U-shaped member was formed out of steel 0.060 inch thick by 1 inch wide, and bearings were formed in the manner shown in FIG. 4. A detent in the storage position only was provided by a tab like that of tab 84 in FIG. 4, but located above the bearings. Steel wire ⅛ inch in diameter was used to form a hoop 3½ in diameter with outwardly pointing shafts. With these dimensions, using steel, it was not necessary to provide for side thrust reaction since the hoop tension can be made great enough to hold the shafts in the bearings for any reasonable side thrust. Detent in the deployed position was not used. A 4 inches deep bag made of 8 ounce duck cloth was used, and the entire structure was found adequate to hold at least a two pound article.

In the embodiments shown in FIGS. 1 through 4, the pivot is on the bight section of a U-shaped member, and the open area of the hoop describes a part of a torus when swung from the deployed position to the storage position. It is also contemplated that the axis of pivotal rotation of the pivotal support means could be generally normal to the plane of the opening of the collapsible holder and/or hoop-like member, thereby enabling or permitting the collapsible holder to be swung in a plane as, for example, parallel to the associated support, as possibly a shelf or ironing board, to which it may be operatively connected via U-shaped member 12.

Although only preferred embodiments have been disclosed, it is apparent that other embodiments and modifications of the invention are possible within the scope of the appended claims.

I claim:

1. A support assembly, comprising collapsible holder means, pivotal support means carrying said collapsible holder means, and detachable securing means operatively connected to said pivotal means, said securing means being effective for securing said pivotal support means to an associated support structure, enabling said pivotal support means to pivotally assume at least first and second positions, said collapsible holder means assuming an extended condition in said first position, and said collapsible holder means assuming a contracted condition in said second position, said securing means comprising a U-shaped member adapted to be removably fixedly secured to said associated support structure, said U-shaped member comprising a bight section, said pivotal support means comprising a hoop-like section, said hoop-like section being generally perpendicular to said bight section in said first position, and said pivotal support means further comprising an extension section operatively formed on and connected to said hoop-like section so as to be perpendicular to said hoop-like section, said extension lying parallel to said bight section in said first position, the end of said extension section being pivotally attached to said bight section, said end of said extension comprising shaft members formed so as to be directed toward each other for engagement with bearing means carried on said bight section, said bearing means comprising an open-ended ridge integrally formed with said bight section of said U-shaped structure, said side thrust reaction members comprising tab means integrally formed with said bight section and extending therefrom to a position generally outboard of said extension section when said pivotal support means is in said first position, and said detent means comprising second tab means integrally formed with said bight section and extending therefrom, said second tab means being effective to engage said extension section when said pivotal support means is in said second position.

2. A support assembly, comprising collapsible holder means, pivotal support means carrying said collapsible holder means, and detachable securing means operatively connected to said pivotal support means, said securing means being effective for securing said pivotal support means to an associated support structure, enabling said pivotal support means to pivotally assume at least first and second positons, said collapsible holder means assuming an extended condition in said first position, and said collapsible holder means assuming a contracted condition in said second position, said securing means comprising a U-shaped member adapted to be removably fixedly secured to said associated support structure, said U-shaped member comprising a bight section, said pivotal support means comprising a hoop-like section, said hoop-like section being generally perpendicular to said bight section in said first position, and said pivotal support means further comprising an extension section operatively formed on and connected to said hoop-like section so as to be perpendicular to said hoop-like section, said extension section lying paralel to said bight section in said first position, the end of said extension section being pivotally attached to said bight section, said end of said extension section comprising shaft members formed so as to be directed away from each other for engagement with bearing means carried on said bight section, said bearing means comprising a pair of open-ended ridges which are colinear and separated and integrally formed with said bight section of said U-shaped structure, and detent means comprising tab means integrally formed with said bight section and extending therefrom so as to be effective to engage said extension section when said pivotal support means is in at least said first and second positions.

3. A support assembly, comprising longitudinally extending collapsible holder means, pivotal hoop-like support means carrying said collapsible holder means, and detachable securing means operatively connected to said pivotal hoop-like support means, said securing means being effective for securing said pivotal support means to an associated support structure thereby enabling said pivotal hoop-like support means to pivotally assume at least a first horizontal position and a second horizontal position, said detachable securing means comprising a generally U-shaped member having first and second leg portions joined by an integrally formed bight portion, said U-shaped member being effective when placed in an operative position as to have said first and second leg portions disposed generally horizontally and at respective different vertical elevations to receive therebetween said associated support structure, said bight portion being generally vertically disposed and interconnecting said first and second leg portions when said U-shaped member is in said operative position, manually actuatable fastener means carried by said second leg portion and effective to engage one side of said associated support structure and thereby forcibly draw said first leg portion securely against an other side of said associated support structure, hinge means carried by said bight portion, said hinge means being situated as to have the hinge axis thereof in a plane generally parallel to and generally between said first and second leg portions, said hoop-like support means comprising a hoop-like member carried by lever means pivotally connected to said hinge means, said lever means comprising first and second lever arms having respective first and second lever arm ends, said first and second lever arm ends respectively defining first and second pivot portions pivotally received in and contained by said hinge means, said first and second lever arms each being of a generally L-shaped configuration whereby when said hoop-like member is in a horizontal position and said U-shaped member is in said operative position a first portion of each of said first and second lever arms depends downwardly from said hinge means and operatively abuts against said bight portion at an elevation generally below said hinge means and whereby a second portion of each of said first and second lever arms extends generally laterally away from said bight portion and carry said hoop-like member at a distance spaced from said bight portion, said second portions being disposed from said pivot portions a distance sufficient to enable said second portions to overlay said first leg portion when said hoop-like member is pivotally rotated about said hinge axis to a position where said hoop-like member also overlays said first leg portion, and first second third and fourth detent members carried by said bight portion, said first and second detent members being situated at an elevation generally above said hinge axis when said U-shaped member is in said operative position, said third and fourth detent members being situated at an elevation generally below said hinge axis when said U-shaped member is in said operative position, said third and fourth detent members being effective to operatively engage and resiliently hold said first and second lever arms when said first portions of said first and second lever arms depend downwardly from said hinge means and operatively abut said bight portion, and said first and second detent members being effective to operatively engage and resiliently hold said first and second lever arms when said first portions of said first and second lever arms are pivoted about said hinge axis as to cause said hoop-like member to overlay said first leg portion, and said collapsible holder means assuming an extended condition downwardly directed from said hoop-like support member when said hoop-like support member is in said horizontal position, and said collapsible holder means assuming a longitudinally contracted condition generally atop said hoop-like support member when said hoop-like support member overlays said first leg portion.

4. A support assembly according to claim 3 wherein said first and second detent members are spaced from each other as to engage said first and second lever arms and resiliently urge said first and second pivot portions into said hinge means thereby functioning as side thrust members for restraining accidental withdrawal of said pivot portions from said hinge means.

5. A support assembly according to claim 5 wherein said hinge means comprises a seperate plate member, wherein each of said detent members is integrally formed on said plate member, and wherein said plate member is fixedly secured to and carried by said bight portion.

* * * * *